United States Patent [19]

Shimizu et al.

[11] Patent Number: 4,634,509

[45] Date of Patent: Jan. 6, 1987

[54] METHOD FOR PRODUCTION OF AQUEOUS QUATERNARY AMMONIUM HYDROXIDE SOLUTION

[75] Inventors: Shumpei Shimizu, Moses Lake, Wash.; Toshitsura Cho; Osamu Yagi, both of Kawasaki, Japan

[73] Assignee: Tama Chemical Co., Ltd., Tokyo, Japan

[21] Appl. No.: 822,073

[22] Filed: Jan. 24, 1986

[30] Foreign Application Priority Data

Jan. 25, 1985 [JP] Japan ..... 60-12109

[51] Int. Cl.[4] ..... C25D 13/06

[52] U.S. Cl. ..... 204/182.4

[58] Field of Search ..... 204/72, 79, 182.4

[56] References Cited

U.S. PATENT DOCUMENTS

| | | | |
|---|---|---|---|
| 3,402,115 | 9/1968 | Campbell et al. | 204/72 |
| 3,523,068 | 8/1970 | Eisenhauer et al. | 204/72 |
| 4,394,226 | 7/1983 | Wade | 204/72 |
| 4,572,769 | 2/1986 | Shimizu | 204/59 R |

*Primary Examiner*—R. L. Andrews

*Attorney, Agent, or Firm*—Armstrong, Nikaido, Marmelstein & Kubovcik

[57] ABSTRACT

An aqueous quaternary ammonium hydroxide solution is produced by a method which is characterized by the steps of synthesizing an inorganic acid salt of quaternary ammonium by the reaction of a trialkylamine with a dialkyl carbonate and the electrolyzing the inorganic acid salt with an electrolytic cell using a cation-exchange membrane as a diaphragm thereby producing quaternary ammonium hydroxide.

5 Claims, No Drawings

METHOD FOR PRODUCTION OF AQUEOUS QUATERNARY AMMONIUM HYDROXIDE SOLUTION

BACKGROUND OF THE INVENTION

1. Field of the Invention

This invention relates to a method for the production of an aqueous quaternary ammonium hydroxide solution of extremely high purity to be used as a treating agent for the washing of semiconductor substrates (wafers) and the development of resist films in the process for the manufacture of semiconductor devices.

2. Description of the Prior Art

In the electronic industry, the aqueous quaternary ammonium hydroxide solution has found extensive utility as a treating agent for the washing and etching of wafers and the development of resist films formed on the cleaned wafers in the process for the manufacture of IC's and LSI's.

If the aqueous quaternary ammonium hydroxide solution so used as the treating agent contains impurities, the impurities remain on the wafers or on the resist films after the work of washing or development and eventually bring about such adverse effects as impairing the precision of IC's and LSI's to be produced or interfering with the operation of electronic circuits. In the storage of the aqueous quaternary ammonium hydroxide solution, there have been times when highly corrosive impurities persisting in the aqueous solution corrode the wall of the container and induce further decline of the purity of the solution.

The contents of impurities in the aqueous quaternary ammonium hydroxide solution, therefore, are rigidly controlled. In U.S. Pat. No. 4,394,226, for example, such cations as Li, Na, K, Fe, Ni, Al, Cr, and Zn are defined not to exceed 10 ppm and such anions as Cl, Br, and I not to exceed 4,000 ppm. In fact, the contents of these impurities are desired to be as low as possible. The desirability of removing such impurities from the aqueous solution to the fullest possible extent has found growing recognition. Particularly, in consequence of the recent notably increasing integration of circuits in semiconductor devices, there has appeared a growing demand for the aqueous quaternary ammonium hydroxide solution which enjoys high purity, excels in stability of storage, and refrains from inducing occurrence of the harmful impurities mentioned above during storage.

For the production of the conventional aqueous quaternary ammonium hydroxide solution, there have been proposed various methods such as are cited below, for example.

One method effects the production of an aqueous quaternary ammonium hydroxide solution by the reaction of an aqueous solution of a halide salt of quaternary ammonium with an aqueous suspension of silver oxide and another method effects the production of an aqueous quaternary ammonium hydroxide solution by the steps of causing chloride of quaternary ammonium to react with potassium hydroxide in methanol and removing the precipitated potassium chloride from the methanol solution by filtration. The first method suffers from inclusion of silver ion in the final product and the latter method suffers from inclusion of chloride and potassium in the final product. Thus, the two species of aqueous quaternary ammonium hydroxide solution obtained by these methods are not applicable to the production of electronic circuits of high quality.

Still another method which is disclosed in U.S. Pat. No. 3,523,068 effects the production of an aqueous quaternary ammonium hydroxide solution by electrolyzing a salt of quaternary ammonium possessing a non-electrolytic anion in an electrolytic cell having an anode and a cathode separated from each other with an intervening cation-exchange membrane. As concrete examples of the non-electrolytic anion, nitrate radical, carbonate radical, and sulfate radical are cited. The specification of this U.S. patent is found to include a statement to the effect that the sulfate radical is particularly desirable as the non-electrolytic anion. In the working examples actually cited, nothing is mentioned of any non-electrolytic anion other than the sulfate radical. Moreover, the aqueous solution produced by this method is intended as an electrolyte or as a pH adjusting agent. Thus, the purity of the product does not matter very much. The significance of purity of the produced aqueous quaternary ammonium hydroxide solution is mentioned nowhere in the specification.

Yet another method intended for the production under discussion is disclosed in U.S. Pat. No. 4,394,226. This method effects the production of an aqueous quaternary ammonium hydroxide of high purity by electrolyzing a halide of quaternary ammonium in an electrolytic cell having an anode and a cathode separated from each other with an intervening cation-exchange membrane. Even this method poses various problems as shown below.

During the course of electrolysis, the anolyte produces harmful and highly corrosive halogen ion and halogen gas both in high concentration, the anode itself which is made of a metal such as platinum is corroded by the halogen ion, for example, and the product of this corrosion passes through the ion-exchange membrane into the catholyte, with the result that the purity of the produced aqueous quaternary ammonium solution will be eventually degraded. Further, the solution obtained at the end of the electrolysis is required to be treated for removal of harmful materials therein, the cost for the disposal of the effluent is consequently increased.

There is another problem that the halogen ion mentioned above deteriorates the anode compartment and the cation-exchange membrane, both made of synthetic resins, during the course of electrolysis. Because of this problem, the ion-exchange membrane made of polystyrene, for example, cannot be used at all in the electrolysis in this case. Even when the cation-exchange membrane made of a fluoro-carbon type resin which excels in durability is used, the aforementioned deterioration is so serious that this membrane will not withstand protracted service. Thus, the membrane does not suit commercial operation of the method.

Moreover, the ion selectivity and the gas barrier property of the cation-exchange membrane are not perfect. The method, therefore, has the disadvantage that the halogen ion and the halogen gas pass through the exchange membrane, both in minute amounts, and mingle into the catholyte, i.e. quaternary ammonium hydroxide. When the aqueous quaternary ammonium hydroxide solution so produced is stored in a generally adopted container of stainless steel, therefore, the highly corrosive halogen ion persisting in the aqueous quaternary ammonium hydroxide solution corrodes the stainless steel container and consequently brings about a decline in the purity of the aqueous solution while in storage.

To overcome the drawbacks suffered by the conventional methods, the inventor already proposed in U.S. patent application No. 665,524 a method for producing an aqueous quaternary ammonium hydroxide solution by synthesizing the formate of quaternary ammonium by the reaction of a trialkylamine with a formic ester and subsequently electrolyzing the formate in an electrolytic cell using a cation-exchange membrane as a diaphragm.

Since this method is capable of avoiding occurrence of a halogen ion in a high concentration in the anolyte during the electrolysis, the otherwise possible deterioration of the cation-exchange membrane can be prevented and the aqueous quaternary ammonium hydroxide solution can be produced in high purity with an improved shelf life.

The inventor, as the result of a continued study, has found that the aqueous quaternary ammonium hydroxide solution obtained by this method contains a minute amount of formate ion ($HCOO^-$) and the formate ion corrodes the stainless steel container and, consequently, the aqueous solution loses slightly in purity while the aqueous solution is kept in storage and that when aqueous quaternary ammonium hydroxide solution of this nature is used as a developing agent, the formate mentioned above has affinity for the resist film of an organic substance and, therefore, produces a notable effect upon the developing property of the aqueous solution, and that there arises the possibility of the uniformity of the developing condition and that of the quality of the final product being impaired by the variation in the formate content of the aqueous solution.

This method has a further problem in that during the electrolysis of the formate of quaternary ammonium, the amount of electricity required is twice as large as when the aforementioned halide of quaternary ammonium is electrolyzed because formic acid is produced on the anode and this formic acid is electrolyzed and oxidized to the level of carbon dioxide gas and, during the synthesis of the formate of quaternary ammonium by the reaction of a trialkylamine with a formic ester, since the formate requires the presence of high temperature (about 130° C.) and high pressure (about 20 kg/cm$^2$), it undergoes partial decomposition to a point where the conversion itself is lowered and the yield of the final product of quaternary ammonium hydroxide is consequently lowered.

SUMMARY OF THE INVENTION

This invention is aimed at providing a method for the production of an aqueous quaternary ammonium hydroxide solution of extremely high purity, which method effects electrolysis without generating a halogen ion or formate ion and consequently causing corrosion of the electrodes or deterioration of the cation-exchange membrane, permits the power consumption for the electrolysis to be lowered to about one half of the level required for the electrolysis of the formate mentioned above, and attains the electrolysis in a high yield and which product excels in stability of storage in a stainless steel container and, when serving as a developing agent, manifests the developing property with perfect consistency.

To be specific, this invention resides in a method for the production of an aqueous quaternary ammonium hydroxide solution, characterized by the steps of synthesizing an inorganic acid salt of quaternary ammonium by the reaction of a trialkylamine with a dialkyl carbonate and then electrolyzing the inorganic acid salt with an electrolytic cell using a cation-exchange membrane as a diaphragm thereby producing quaternary ammonium hydroxide.

Concrete examples of the trialkylamine mentioned above include trimethylamine, $(CH_3)_3N$, and triethylamine, $(C_2H_5)_3N$, and concrete examples of the dialkyl carbonate include dimethyl carbonate, $[(CH_3)_2CO_3]$, and diethyl carbonate, $[(C_2H_5)_2CO_3]$. These compounds are caused to react with each other in a solvent such as methyl alcohol or ethyl alcohol to synthesize a corresponding inorganic acid salt of quaternary ammonium.

The molar ratio of the trialkylamine and the dialkyl carbonate in the reaction is required to be at least 1 mole, preferably 2 or more moles, of the trialkylamine to 1 mole of the dialkyl carbonate. Addition of 2 or more moles of the trialkylamine is desirable because the reaction produces a ditetraalkyl ammonium carbonate having two quaternary ammonium ions attached thereto and, consequently, the expensive dialkyl carbonate can be utilized with high efficiency. The reaction temperature is required to fall in the range of 100° C. (under reaction pressure of 6.0 kg/cm$^2$) to 150° C. (under reaction pressure of 20 kg/cm$^2$), preferably 140° C. to 150° C. The reaction time is required to exceed more than 2 hours, preferably more than 4 hours.

Specifically, it has been confirmed experimentally that ditetramethyl ammonium carbonate having two quaternary ammonium ions attached thereto is synthesized in a ratio exceeding 90% when 2 moles of trimethylamine and 1 mole of dimethyl carbonate are caused to react with each other under the conditions of 140° C. of reaction temperature, 16 kg/cm$^2$ of reaction pressure, and 5.5 hours of reaction time.

Then, the product of the reaction mentioned above is distilled under a vacuum or otherwise to expel the reaction solvent such as methyl alcohol and the unaltered portions of trialkylamine and dialkyl carbonate. Subsequently, the reaction product remaining after the distillation is dissolved in pure water and again subjected to distillation under a vacuum or otherwise. The reaction product obtained after the distillation is recognized to be free from an alkyltetraalkyl ammonium carbonate having one quaternary ammonium ion attached thereto.

Then, the inorganic acid salt of quaternary ammonium produced by the reaction mentioned above, i.e. the aqueous solution of a ditetraalkyl ammonium carbonate, a hydrogen tetraalkyl ammonium carbonate, or a mixture thereof, is supplied to the anode compartment of an electrolytic cell using a cation-exchange membrane as a diaphragm, there to be electrolyzed by application of a DC potential. The electrolysis which causes the quaternary ammonium ion to migrate through the cation-exchange membrane into the cathode compartment will eventually produce quaternary ammonium hydroxide. During this electrolysis, hydrogen occurs on the cathode and carbon dioxide gas and oxygen on the anode.

The cation-exchange membrane to be used in this electrolysis is desired to be made of a fluoro-carbon type substance which excels in durability. This electrolysis tolerates use of an exchange membrane of a less expensive polystyrene or polypropylene type substance because it is incapable of generating a halogen ion or formate ion which is detrimental to the cation-exchange membrane.

As the anode to be inserted in the electrolytic cell mentioned above, a high-purity graphite electrode or a titanium electrode coated with the oxide of a platinum family element can be used. The cathode can be made of stainless steel or nickel which resists alkalis.

For the purpose of electrolysis in the electrolytic cell, the current density is desired to be fixed in the range of 1 to 50 A/dm$^2$. The supply of the aqueous solution of the inorganic acid salt of quaternary ammonium to the electrolytic cell may be advantageously effected by means of circulation. The retention time of a given solution in the anode compartment and in the cathode compartment is not allowed to exceed 60 seconds and is desired to fall in the range of 1 to 10 seconds. In this case, the supply of the inorganic acid salt mentioned above is made to the anode compartment. The concentration of the inorganic acid salt in the solution reaching the anode compartment is not allowed to exceed 60% by weight and is desired to fall in the range of 5 to 40% by weight. To the cathode compartment is supplied pure water. Generally, pure water has low conductivity of electricity such that, when the electrolytic cell is started operating, the electrolysis occurs only with difficulty. Thus, the pure water so supplied to the cathode compartment is desired to contain about 0.01 to 1.0% by weight of quaternary ammonium hydroxide.

Since this invention is directed to the production of an aqueous quaternary ammonium hydroxide solution of extremely high purity, it is desirable that the trialkylamine, the dialkyl carbonate, and the pure water adopted as raw materials should be used in a highly purified form and the component parts of the electrolytic cell and the tank for storing the circulation fluid should be thoroughly cleaned prior to use. Further, the electrolytic cell and the storage tank are desired to be kept sealed with an inert gas of high purity throughout the entire course of electrolysis.

In accordance with this invention, since the aqueous quaternary ammonium hydroxide solution is produced by electrolyzing the inorganic acid salt of quaternary ammonium synthesized by the reaction of a trialkylamine with a dialkyl carbonate, the electrolysis does not entail occurrence of the halogen ion or the formate ion of the aforementioned nature and, instead of causing corrosion or deterioration of the exchange membrane and the like, permits production of an aqueous quaternary ammonium hydroxide solution having high purity, excelling in stability of storage, and, when used as a developing agent, manifesting a consistent developing property. Further, the cost of disposal of the effluent from the electrolytic cell is notably low, because the carbonate ion formed inside the anode compartment is discharged in the form of carbon dioxide gas from the system and, consequently, the concentration of inorganic substances in the anolyte is very small as compared with that involved when the conventional salt is used for the electrolysis.

DETAILED DESCRIPTION OF THE PREFERRED EMBODIMENT

Now, this invention will be described more specifically below with reference to working examples and comparative experiments.

EXAMPLE 1

In 200 g of methyl alcohol, 124 g (about 2.1 moles) of trimethylamine and 95 g (about 1.05 moles) of dimethyl carbonate were dissolved. In a reaction vessel, the resultant solution was left reacting under the conditions of 120° C. of reaction temperature, 13 kg/cm$^2$ of reaction pressure, and 5.5 hours of reaction time.

The reaction product was deprived of the methyl alcohol and the unaltered portions of trimethylamine and dimethyl carboante by vacuum distillation. Then, the reaction product was dissolved in 0.2 liter of pure water and again subjected to vacuum distillation for thorough removal of the residual methyl alcohol, etc. from the aqueous solution. By addition of pure water, the distillate was converted into 1 liter of an aqueous solution of inorganic acid salt of quaternary ammonium.

Separately, an electrolytic cell was prepared which consisted of an anode compartment made of stainless steel (SUS 304), coated with fluoro-carbon, and provided therein with an anode of graphite, a cathode compartment made of stainless steel (SUS 304) and provided therein with a cathode of stainless steel (SUS 304), and an ion-exchange membrane of a fluoro-carbon type (produced by DuPont and marketed under trademark designation of "Nafion 324") interposed between the two compartments mentioned above.

Then, the aforementioned aqueous solution of inorganic acid salt of quaternary ammonium was circulated through the interior of the anode compartment of the electrolytic cell under the condition of 2.5 seconds of retention time in the anode compartment and, at the same time, an aqueous solution containing 0.01 mole of tetramethyl ammonium hydroxide per liter was circulated through the interior of the cathode compartment under the condition of 5 seconds of retention time in the cathode compartmemt. In the system so established, electrolysis was effected for 32 hours by applying a DC potential of 13 V in voltage and about 2.0 A/dm$^2$ in current density between the anode and the cathode. Consequently there was produced an aqueous solution having 175 g of tetramethyl ammonium hydroxide dissolved therein. The estimation of tetramethyl ammonium hydroxide in this case and in all the following working examples and comparative experiments as well was carried out by the method of neutralization titration.

EXAMPLE 2

Electrolysis of tetramethyl ammonium carbonate was carried out by faithfully following the procedure of Example 1, except that an electrode made of platinum was used in the place of the electrode made of graphite. Consequently, an aqueous solution having 176 g of tetramethyl ammonium hydroxide dissolved therein was obtained.

EXAMPLE 3

Electrolysis was carried out by faithfully following the procedure of Example 1, except that the electrolytic cell used therein had a polystyrene type cation-exchange membrane (produced by Tokuyama Soda Co., Ltd. and marketed under designation of "C66-10F") interposed between the anode compartment and the cathode compartment. Consequently, an aqueous solution having 174 g of tetramethyl ammonium hydroxide dissolved therein was obtained.

EXAMPLE 4

In 200 g of methyl alcohol, 124 g (about 2.1 moles) of trimethylamine and 190 g (about 2.1 moles) of dimethyl carbonate were dissolved. In a reaction vessel, the resultant solution was left reacting under the conditions of 110° C. of reaction temperature, 6.1 kg/cm$^2$ of reaction pressure, and 5.5 hours of reaction time.

The product of this reaction was deprived of the methyl alcohol and the unaltered portions of trimethylamine and dimethyl carbonate by vacuum distillation. Then, the reaction product was dissolved in 0.2 liter of pure water and again subjected to vacuum distillation to effect thorough removal of the residual methyl alcohol, etc. from the aqueous solution. By addition of pure water, the resultant distillate was converted into 1 liter of an aqueous solution of inorganic acid salt of quaternary ammonium.

In the same electrolytic cell as used in Example 1, the aforementioned aqueous solution of inorganic acid salt of quaternary ammonium was circulated through the interior of the anode compartment under the condition of 2.5 seconds of retention time in the anode compartment and, at the same time, an aqueous solution containing 0.01 mole of tetramethyl ammonium hydroxide per liter was circulated through the interior of the cathode compartment under the condition of 5 seconds of retention time in the cathode compartment. In the system thus established, electrolysis was effected for about 40 hours by applying a DC potential of 13 V in voltage and about 2.0 A/dm$^2$ in current density between the anode and the cathode. Consequently, an aqueous solution having 182 g of tetramethyl ammonium hydroxide dissolved therein was obtained.

In none of the aqueous quaternary ammonium hydroxide solutions obtained in Examples 1–4 cited above, methyl alcohol detrimental to the developing property of the solution used as a developing agent was contained.

COMPARATIVE EXPERIMENT 1

In 200 g of methyl alcohol, 124 g (about 2.1 moles) of trimethylamine and 126 g (about 2.1 moles) of methyl formate were dissolved. In a reaction vessel, the resultant solution was left reacting under the conditions of 132° C. of reaction temperature, 18.4 kg/cm$^2$ of reaction pressure, and 5.5 hours of reaction time.

The reaction product was deprived of the methyl alcohol and the unaltered portions of trimethylamine and methyl formate by vacuum distillation. Then, the reaction product was dissolved in 0.2 liter of pure water and again subjected to vacuum distillation to effect thorough removal of the residual methyl alcohol, etc. from the aqueous solution. By addition of pure water, the resultant distillate was converted into 1 liter of an aqueous tetramethyl ammonium formate solution.

In the same electrolytic cell as used in Example 1, the aforementioned aqueous solution of tetramethyl ammonium formate was circulated through the interior of the anode compartment under the condition of 2.5 seconds of retention time in the anode compartment and, at the same time, an aqueous solution containing 0.01 mole of tetramethyl ammonium hydroxide per liter was circulated through the interior of the cathode compartment under the condition of 5 seconds of retention time in the cathode compartment. In the system so established, electrolysis was effected for about 47 hours by applying a DC potential of 13 V in voltage and about 2.0 A/dm$^2$ in current density between the anode and the cathode. Consequently, an aqueous solution having 127 g of tetramethyl ammonium hydroxide dissolved therein was obtained.

COMPARATIVE EXPERIMENT 2

Electrolysis of tetramethyl ammonium formate was carried out by faithfully following the procedure of Comparative Experiment 1, except that an electrode made of platinum was used in the place of the electrode of graphite in the electrolytic cell. Consequently, an aqueous tetramethyl ammonium hydroxide solution was obtained.

The products of Examples 1–4 and Comparative Experiments 1–2 were analyzed to determine yield of tetramethyl ammonium hydroxide and concentration of impurities in the aqueous solution. The results are shown in Table 1.

The data of cation concentration given in this table had been obtained by the flameless atomic absorption method and those of anion concentration by the ion chromatographic method.

TABLE 1

| | Amount of final product (g) | Impurities | | | | | | | | | | |
|---|---|---|---|---|---|---|---|---|---|---|---|---|
| | | Cl | Na | Fe | Ni | Cr | Ca | Al | Pt | $HCOO^-$ | $CO_3^{2-}$ | Mg, Mn, Zn, Cu, Co |
| Example 1 | 175 | Below DL* (0.2 ppm) | 6 ppb | 5 ppb | Below DL (1 ppb) | Below DL (1 ppb) | 3 ppb | Below DL (2 ppb) | Below DL (20 ppb) | Below DL (0.2 ppm) | 800 ppm | Below DL (1 ppb) |
| Example 2 | 176 | Below DL* (0.2 ppm) | 6 ppb | 5 ppb | Below DL (1 ppb) | Below DL (1 ppb) | 3 ppb | Below DL (2 ppb) | Below DL (20 ppb) | Below DL (0.2 ppm) | 800 ppm | Below DL (1 ppb) |
| Example 3 | 174 | Below DL* (0.2 ppm) | 7 ppb | 5 ppb | Below DL (1 ppb) | Below DL (1 ppb) | 4 ppb | Below DL (2 ppb) | Below DL (20 ppb) | Below DL (0.2 ppm) | 800 ppm | Below DL (1 ppb) |
| Example 4 | 182 | Below DL* (0.2 ppm) | 6 ppb | 5 ppb | Below DL (1 ppb) | Below DL (1 ppb) | 3 ppb | Below DL (2 ppb) | Below DL (20 ppb) | Below DL (0.2 ppm) | 800 ppm | Below DL (1 ppb) |
| Comparative Experiment 1 | 127 | Below DL* (0.2 ppm) | 6 ppb | 7 ppb | Below DL (1 ppb) | Below DL (1 ppb) | 5 ppb | Below DL (2 ppb) | Below DL (20 ppb) | 2500 ppm | 800 ppm | Below DL (1 ppb) |
| Comparative Experiment 2 | 128 | Below DL* | 6 ppb | 7 ppb | Below DL | Below DL | 5 ppb | Below DL | Below DL | 1800 ppm | 800 ppm | Below DL |

TABLE 1-continued

| | Amount of final product (g) | Impurities | | | | | | | | | | |
|---|---|---|---|---|---|---|---|---|---|---|---|---|
| | | Cl | Na | Fe | Ni | Cr | Ca | Al | Pt | $HCOO^-$ | $CO_3^{2-}$ | Mg, Mn, Zn, Cu, Co |
| | | (0.2 ppm) | | | (1 ppb) | (1 ppb) | | (2 ppb) | (20 ppb) | | | (1 ppb) |

*DL = Detectable limit

The amount (g) of final product indicated above means the weight of quaternary ammonium hydroxide dissolved in the aqueous quaternary ammonium hydroxide solution produced in the indicated experiment.

It is noted from Table 1 that the yields (in g) of the final products of Examples 1–4 are remarkably higher than those of the final products of Comparative Experiments 1–2.

In the aqueous tetramethyl ammonium hydroxide solutions produced in Examples 1–4, the contents of formate ion ($HCOO^-$) were all below the detectable limit (0.2 ppm) and those of Cl, Na, Fe, Ni, Cr, Ca, Al, Pt, carbonate ion ($CO_3^{2-}$), Mg, Mn, Zn, Cu, and Co were on equal levels falling within the respective allowable limits which the aqueous solution as a treating agent is required to satisfy. These results indicate that the aqueous solutions had extremely purity so that, when used as a developing agent, they would manifest substantially consistent developing property.

The aqueous tetramethyl ammonium hydroxide solutions produced in Comparative Experiments 1–2 respectively contained 2,500 ppm and 1,800 ppm of formate ion ($HCOO^-$). The formate ion content was readily variable with the production condition of the aqueous solution. If the aqueous solution of this grade was used as a developing agent, therefore, the affinity of the agent for the resist film under treatment would be varied by the content of the formate ion, an organic substance and the speed of development would be varied accordingly, with the result that delicate changes caused in the condition of development would seriously affect the quality of the final product.

Example 3 demonstrates that an aqueous tetramethyl ammonium hydroxide solution of high purity could be obtained even when the cation-exchange membrane used therein was made of a polystyrene type substance of low durability.

Samples of the aqueous tetramethyl ammonium hydroxide solutions produced in Example 1 and Comparative Experiment 1 were independently stored in containers of stainless steel at 70° C. for 30 days. After the standing, they were tested for Fe concentration. In the sample of Example 1, the Fe concentration was 10 ppb, indicating virtually no change from the concentration at the beginning of the storage. By contrast, in the sample of Comparative Experiment 1, the Fe concentration was found to be 100 ppb, indicating a notable increase from the concentration at the beginning of the storage. From this fact, it is logically concluded that the aqueous quaternary ammonium hydroxide solution obtained by the procedure of Example 1 excels in stability of storage.

As described in detail above, the present invention provides a method capable of inexpensively producing an aqueous quaternary ammonium hydroxide solution, which method effects electrolysis without generating a halogen ion or formate ion and consequently causing corrosion of the electrodes or deterioration of the cation-exchange membrane, permits the power consumption for the electrolysis to be lowered to about one half of the level required for the electrolysis of the formate, and attains the electrolysis in a high yield and which product enjoys extremely high purity, excels in stability of storage in a container of stainless steel, and proves useful as a treating agent in the washing of wafers and the developing of resist films during the course of manufacture of semiconductor devices.

What is claimed is:

1. A method for the production of an aqueous quaternary ammonium hydroxide solution of high purity, comprising the steps of:

(1) preparing an aqueous solution of an inorganic acid salt of quaternary ammonium of high purity by reacting of trialkylamine with a dialkyl carbonate in an alcohol solvent; then removing the alcohol solvent, unreacted trialkylamine and unreacted dialkyl carbonate by distillation; and dissolving the resultant distillate in pure water to give an aqueous solution of an inorganic acid salt of quaternary ammonium of high purity, said inorganic acid salt consisting of at least one compound selected from the group consisting of ditetraalkyl ammonium carbonate and hydrogen tetraalkyl carbonate;

(2) electrolyzing said aqueous solution of the inorganic acid salt of quaternary ammonium of high purity in an electrolytic cell comprising an anode compartment, a cathode compartment and a cation-exchange membrane as a diaphragm under conditions wherein the aqueous solution of the inorganic acid salt of quaternary ammonium is circulated through the interior of the anode compartment at a retention time of not more than 60 seconds, thereby producing a solution of quaternay ammonium hydroxide of high purity.

2. A method according to claim 1, wherein said inorganic acid salt is ditetramethyl ammonium carbonate.

3. A method according to claim 1, wherein said inorganic acid salt is hydrogen tetramethyl ammonium carbonate.

4. A method according to claim 1, wherein said inorganic acid salt is a mixture of ditetramethyl ammonium carbonate with hydrogen tetramethyl ammonium carbonate.

5. A method according to claim 1, wherein an aqueous solution containing 0.01–1.0% by weight of quaternary ammonium hydroxide is circulated through the interior of the cathode compartment.

* * * * *